US007268289B2

(12) United States Patent
Muramatsu et al.

(10) Patent No.: US 7,268,289 B2
(45) Date of Patent: Sep. 11, 2007

(54) MUSICAL INSTRUMENT PERFORMING ARTISTIC VISUAL EXPRESSION AND CONTROLLING SYSTEM INCORPORATED THEREIN

(75) Inventors: Shigeru Muramatsu, Shizuoka (JP); Yasuhiko Ohba, Shizuoka (JP); Yuji Fujiwara, Shizuoka (JP)

(73) Assignee: Yamaha Corporation, Shizuoka-Ken (JP)

( * ) Notice: Subject to any disclaimer, the term of this patent is extended or adjusted under 35 U.S.C. 154(b) by 196 days.

(21) Appl. No.: 11/032,190

(22) Filed: Jan. 10, 2005

(65) Prior Publication Data

US 2005/0150361 A1 Jul. 14, 2005

(30) Foreign Application Priority Data

Jan. 13, 2004 (JP) ..... 2004-005907

(51) Int. Cl.
*G10H 1/32* (2006.01)

(52) U.S. Cl. ..... 84/719; 84/718; 84/743; 84/744

(58) Field of Classification Search ..... None
See application file for complete search history.

(56) References Cited

U.S. PATENT DOCUMENTS 5,627,333 A * 5/1997 Stahnke et al. ..... 84/462
6,380,469 B2 4/2002 Uehara
6,380,472 B1 4/2002 Sugiyama et al.
2001/0007219 A1 * 7/2001 Uehara et al. ..... 84/609
2001/0054346 A1 12/2001 Uehara

FOREIGN PATENT DOCUMENTS

EP 0747876 12/1996
EP 1172796 1/2002
JP 9-62255 3/1997

* cited by examiner

*Primary Examiner*—Marlon Fletcher
(74) *Attorney, Agent, or Firm*—Harness, Dickey & Pierce, PLC

(57) ABSTRACT

A set of formation data codes, which includes action event codes and duration codes, is loaded in an automatic player piano, and a controller interprets the action event codes for driving the solenoid-operated key actuators; since the solenoid-operated key actuators slowly push the associated keys, the hammers do not reach the strings, and any piano tone is not produced; the plungers make the keys sunk to different depth so that the keys are laid on a artistic pattern; the controller sequentially changes the artistic pattern, and offers an artistic visual expression to the audience.

24 Claims, 9 Drawing Sheets

MUSICAL INSTRUMENT PERFORMING ARTISTIC VISUAL EXPRESSION AND CONTROLLING SYSTEM INCORPORATED THEREIN

FIELD OF THE INVENTION

This invention relates to a musical instrument and, more particularly, to a musical instrument of the type offering various sorts of pleasure to users and a controlling system incorporated therein.

DESCRIPTION OF THE RELATED ART

An automatic player piano is a typical example of the automatic player musical instrument, and is, by way of example, disclosed in Japanese Patent Application laid-open No. Hei 9-62255. Although not only the piano tones but also taps on the keys and key bed are reproduced through the prior art automatic player piano, the standard key drive techniques are employed for producing the piano tones. In detail, the solenoid-operated key actuators are provided under the black and white keys, and the controller selectively energizes the solenoids so as to give rise to the key motion with the plungers. The keys actuate the associated action units, and the action units drive the hammers for rotation through the escape therefrom. The hammers are brought into collision with the associated strings at the end of the rotation, and give rise to vibrations of the strings for producing the piano tones. The taps on the keys and taps on the key bed are electronically produced in parallel to the piano tones.

The users have two options in the prior art automatic player pianos. The first option is that they enjoy their performance on the automatic player pianos. Otherwise, they enjoy the playback through the automatic players. If the automatic player pianos offered other pleasure to the users, the automatic player pianos would find acceptance with more users.

The applicant searches the prior art database for other usage. An automatic player piano, which is disclosed in U.S. Pat. No. 6,380,469B2, offers the other usage to the users. In detail, the prior art automatic player piano is changed between the automatic playing and practices in fingering on the keys. When a user wishes to practice the fingering, the solenoid-operated key actuators slightly sink the black and white keys before the use depresses the black and white keys. The controller analyzes the standard MIDI music data codes for the guidance, and gives rise to the shallow key motion for the guidance. Thus, the user can practice the fingering on the keyboard under the guidance of the automatic playing system.

Another keyboard musical instrument, which is disclosed in U.S. Pat. No. 6,380,472B1, is provided in association with an electric tutor. When a user requests the electric tutor to guide him in fingering on the keyboards, the electric tutor starts to give previous notices through induction actions to the user. When the controller gives the previous notice to the user, the key is sunk to the certain depth shorter than the full stroke of the key. The electric tutor analyzes the standard MIDI music data codes for the guidance, and gives rise to the induction actions before the user depresses the keys.

Thus, the usage of the prior art keyboard musical instruments is limited to the performance, playback and guidance. The present inventors wish to offer another sort of usage drastically different from that of the prior art keyboard musical instruments.

SUMMARY OF THE INVENTION

It is therefore an important object of the present invention to provide a musical instrument, through which users enjoys artistic visual expression as well as music performance.

It is also an important object of the present invention to provide a controlling system, which makes the users give the artistic visual expression through the musical instrument.

In accordance with one aspect of the present invention, there is provided a musical instrument for producing tones comprising plural manipulators assigned respective manipulator numbers and selectively moved between respective rest positions and respective end positions for specifying an attribute of the tones, a tone generating system connected to the plural manipulators and actuated by the plural manipulators for producing the tones at the attribute specified through the plural manipulators, and a controlling system including plural actuators respectively associated with the plural manipulators and responsive to driving signals so as to give rise to motion of the plural manipulators and a controller analyzing action event codes indicative of at least a velocity of the manipulators to be moved without producing the tones, the manipulator numbers of the manipulators and a stroke from the rest positions and supplying the driving signals representative of the velocity and target values of the stroke to the actuators associated with the manipulators to be moved.

In accordance with another aspect of the present invention, there is provided a controlling system to be installed in association with a musical instrument and selectively moving plural manipulators forming parts of the musical instrument comprising plural actuators respectively associated with the plural manipulators and responsive to driving signals so as selectively to give rise to motion of the plural manipulators, and a controller analyzing action event codes indicative of at least a velocity of the manipulators to be moved without producing a tone, manipulator numbers of the manipulators and a stroke from the rest positions and supplying the driving signals representative of the velocity and target values of the stroke to the actuators associated with the manipulators to be moved.

BRIEF DESCRIPTION OF THE DRAWINGS

The features and advantages of the musical instrument and controlling system will be more clearly understood from the following description taken in conjunction with the accompanying drawings, in which.

DESCRIPTION OF THE PREFERRED EMBODIMENTS

Figure 1:
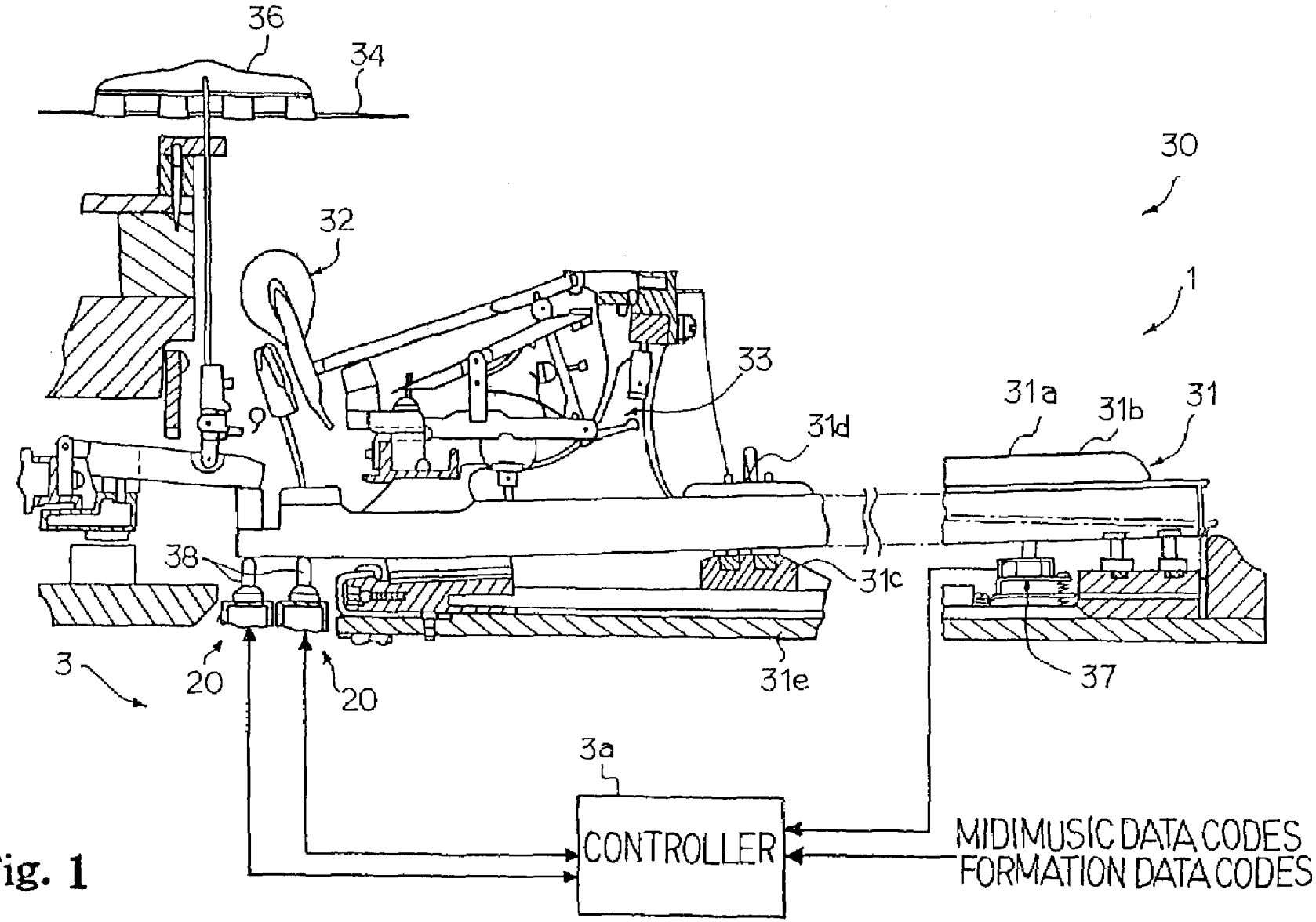
FIG. 1 is a side view showing the structure of a keyboard musical instrument according to the present invention.

In the following description, term "front" is indicative of a position closer to a player, who is sitting on a stool for fingering, than a position modified with term "rear". A line passing through a front position and a corresponding rear position extends in the "fore-and-aft direction", and the fore-and-aft direction crosses a "lateral direction" at right angle.

First Embodiment

Structure of Musical Instrument

A keyboard musical instrument 30 embodying the present invention largely comprises an acoustic piano 1 and a controlling system 3. The acoustic piano 1 is a standard grand piano, and users play pieces of music on the acoustic piano. The controlling system 3 is installed in the acoustic piano 1, and cooperates with the acoustic piano 1. Since the controlling system 3 is available for a playback on the acoustic piano 1, the keyboard musical instrument 30 may be recognized as an automatic player piano. For this reason, the controlling system 3 automatically reenacts the performance on the acoustic piano 1 as an automatic player, and expresses a visual fine pattern. Thus, the acoustic piano 1 makes the users enjoy themselves through the performance, and the controlling system 3 gives the artistic visual expression to the audience.

The acoustic piano 1 includes a keyboard 31, hammers 32, action units 33, strings 34 and dampers 36. The keyboard 31 includes black keys 31*a* and white keys 31*b*, and the black keys 31*a* and white keys 31*b* are laid on the well-known pattern. A balance rail 31*c* laterally extends over a key bed 31*e*, and the black keys 31*a* and white keys 31*b* rest on the balance rail 31*c* in such a manner as to cross the balance rail 31*c* at right angle. Balance pins 31*d* upwardly project from the balance rail 31*c* at intervals, and offer fulcrums to the black/white keys 31*a*/31*b*. When a user depresses the front end portions of the black and white keys 31*a*/31*b*, the front end portions are sunk toward the key bed 31*e*, and the rear portions are lifted like a seesaw.

The black/white keys 31*a*/31*b* are respectively linked with the action units 33 so that depressed keys 31*a*/31*b* actuate the associated action units 33. The hammers 32 rest on the jacks, which form respective parts of the action units 33, and are driven for rotation through the escape of the jacks. The strings 34 are stretched over the associated hammers 32, and are struck with the associated hammers 32 at the end of the rotation. The dampers 36 are held in contact with the associated strings 34, and are lifted by the associated depressed keys 31*a*/31*b* so as to permit the associated strings 34 to vibrate for producing piano tones. When the user releases the depressed keys 31*a*/31*b*, the dampers 36 are brought into contact with the associated strings 34 on the way of the associated keys 31*a*/31*b* to the rest positions.

The controlling system 3 includes a controller 3*a*, an array of solenoid-operated key actuators 20 and an array of key sensors 37. The controller 3*a* has a data processing capability, and suitable computer programs are installed therein. The solenoid-operated key actuators 20 and key sensors 37 are connected to the controller 3*a*. The solenoid-operated key actuators 20 are provided under the rear portions of the black and white keys 31*a*/31*b*, and the controller 3*a* selectively energizes the solenoid-operated key actuators 20. On the other hand, the array of key sensors 37 is provided under the front portions of the black and white keys 31*a*/31*b*, and supply current key positions between the rest positions and the end positions to the controller 3*a*.

When a user wishes to reproduce a performance, the user instructs the controller 3*a* to prepare for a playback, and a set of MIDI (Musical Instrument Digital Interface) music data codes, which represents the performance, is loaded to the controller 3*a*. The controller 3*a* sequentially processes the MIDI music data codes so as to determine reference trajectories on which the black and white keys 31*a*/31*b* are to travel. When timing at which a certain key 31*a*/31*b* is to be moved, the controller 3*a* supplies a driving signal to the solenoid-operated key actuator 20 under the certain key 31*a*/31*b*, and energizes the solenoid. Then, the plunger 38 projects upwardly, and pushes the rear portion of the certain key 31*a*/31*b*. Though not shown in FIG. 1, built-in plunger sensors are incorporated in the solenoid-operated key actuators 20, and reports the current plunger position to the controller 3*a*. The controller 3*a* compares the current plunger position with the corresponding target plunger position on the reference trajectory to see whether or not the certain key 31*a*/31*b* accurately travels on the reference trajectory. If the answer is given negative, the controller 3*a* varies the driving signal so as to decelerate the plunger 38. On the other hand, when the controller 3*a* confirms that the certain key 31*a*/31*b* accurately travels on the reference trajectory, the controller 3*a* keeps the driving signal. Thus, the controller 3*a* sequentially drives the plungers 38 so as to give rise to the key motion in the original performance. The black and white keys 31*a*/31*b* actuate the associated action units 33, and cause the hammers 32 to be brought into collision with the associated strings 34 at the end of the rotation for producing the piano tones.

If, on the other hand, a user instructs the controller 3*a* to lay the black and white keys 31*a*/31*b* on an artistic pattern, the controller 3*a* adjusts the driving signals to proper magnitudes, and supplies the driving signals to the solenoid-operated key actuators 20 under the black/white keys 31*a*/31*b*. The driving signals keep the plungers 38 at different strokes so that the black/white keys 31*a*/31*b* are laid on the artistic pattern as will be described hereinafter in detail.

Electronic System

Figure 2:
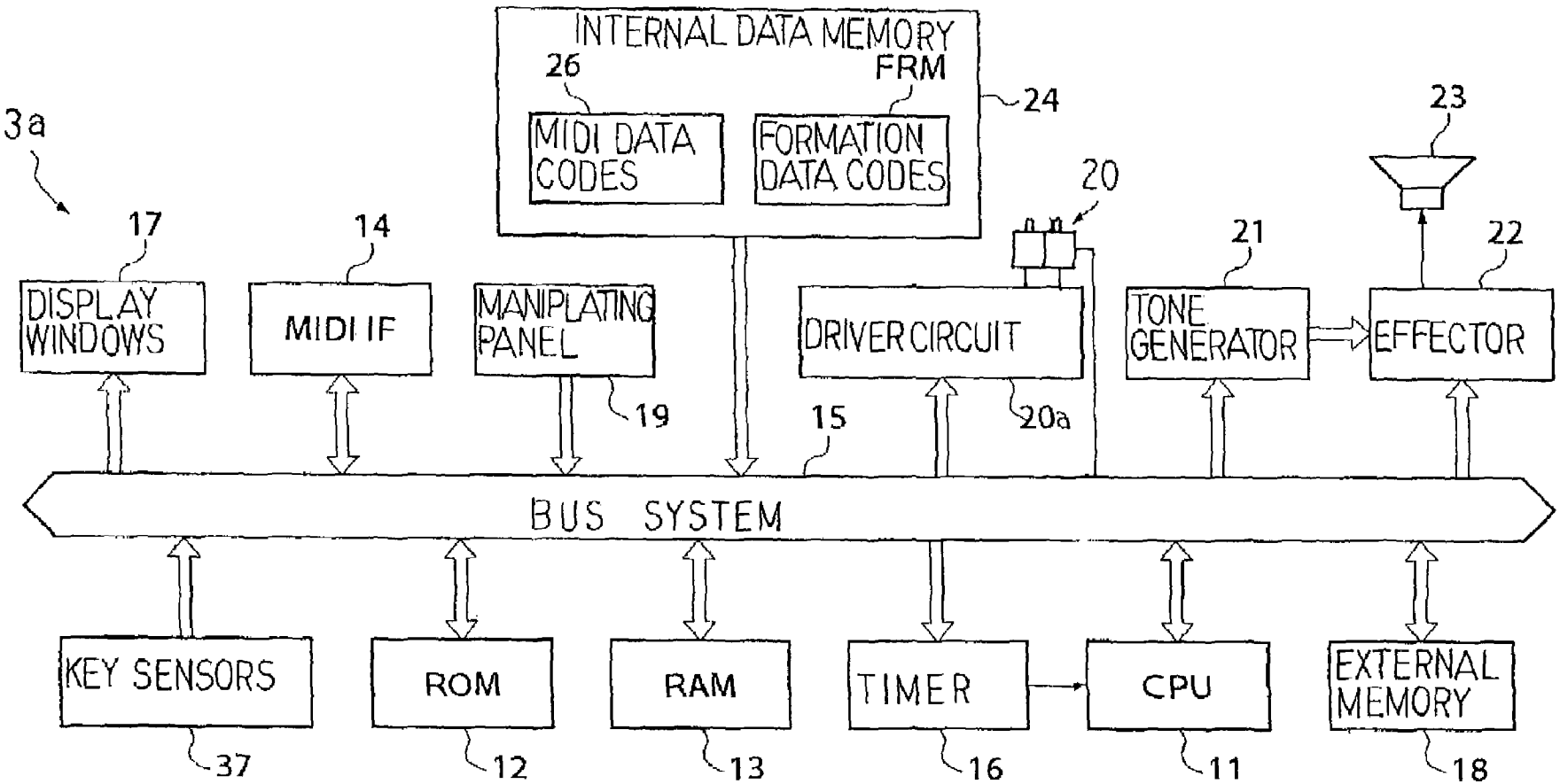
FIG. 2 is a block diagram showing the system configuration of a controlling system incorporated in the keyboard musical instrument.

Turning to FIG. 2, the controller 3*a* includes a central processing unit 11, which is abbreviated as "CPU", a read only memory 12, which is abbreviated as "ROM", a random access memory 13, which is abbreviated as "RAM", a MIDI interface 14, which is abbreviated as "MIDI IF", a bus system 15 and a timer 16. The central processing unit 11, read only memory 12, random access memory 13, MIDI interface 14 and timer 16 are connected to the bus system 15, and the central processing unit 11 communicates with other system components through the bus system 15.

The central processing unit 11 is the origin of the data processing capability, and computer programs are stored in the read only memory 12. The central processing unit 11 sequentially fetches program instructions, which form the computer programs, from the read only memory 12, and performs a given data processing expressed by the program instructions. Parameter tables and coefficients, which are required for the data processing, are further stored in the read only memory 12. The random access memory 13 offers a temporary data storage to the central processing unit 11, and serves as a working memory. A predetermined memory area is assigned to flags.

The MIDI interface 14 is connected to another musical instrument or a personal computer system through a MIDI cable, and MIDI music data codes are output from or input to the MIDI interface 14. A lapse of time is measured with the timer 16, and the central processing unit 11 reads out the time or lapse of time on the timer 16 so as to determine the timing at which an event is to occur. Moreover, the timer 16 periodically makes the main routine program branch to subroutine programs through timer interruption. The timer 16 may be a software timer.

The controller 3*a* further includes a display window 16, a manipulating panel 19, a driver circuit 20*a*, a tone generator 21, an effector 22, an internal data memory 24 and interfaces connected to an external memory 18, the key sensors 37 and a sound system 23. These system components 16, 19, 20*a*, 21, 22, 24 and interfaces are also connected to the bus system 15 so that the central processing unit 11 is also communicable with those system components 16-24 and interfaces. The driver circuit 20*a* may be integrated with the solenoid-operated key actuators 20. In this instance, the central processing unit 11 supplies a control signal indicative of the magnitude of the driving signal through an interface to the driver circuit 20*a*.

The display window 16 is a man-machine interface. Character images for status messages and prompt messages are produced in the display window 16, and symbols and images of scales/indicators are further produced in the display window 16 so that the users acquire status information representative of the current status of the keyboard musical instrument from the display window 17. Images of notes on the staff notation are further produced on the display window 16, and the users play pieces of music with the assistance of the notes on the staff notation.

Button switches, ten keys and levers are arrayed on the manipulating panel 19. The users selectively push and move the switches, keys and levers so as to give their instructions to the controlling system 3*a*. The driver circuit 20*a* is responsive to pieces of control data representative of the magnitude of the driving signals so as to adjust the driving signals to the target magnitude. The magnitude may be given as a duty ratio or mean current of the driving signals. When the user instructs the controller 3*a* to reproduce a piece of music or lay the black and white keys 31*a*/31*b* on a fine artistic pattern through the manipulating panel 19, the main routine program branches a subroutine program, and the central processing unit 11 sequentially fetches of program instructions of the subroutine program. The central processing unit 11 sequentially reads out the MIDI music data codes or formation data codes from the internal data memory 24, and reenacts the performance or lays the black/white keys 31*a*/31*b* on the artistic pattern.

The tone generator 21 produces a digital audio signal on the basis of the MIDI music data codes, and supplies the digital audio signal to the effector 22. The effector 22 is responsive to the control data codes representative of effects of tones so that the digital audio signal is modified in the effector 22. A digital-to-analog converter is incorporated in the effector 22. The digital audio signal is converted to an analog audio signal, and the analog audio signal is supplied to the sound system 23. The analog audio signal is equalized and amplified, and, thereafter, converted to electronic tones. Thus, the keyboard musical instrument can produce the electronic tones instead of the piano tones generated through the vibrating strings 34.

The internal data memory 24 is much larger in data holding capacity than the random access memory 13, and sets of MIDI music data codes and sets of formation data codes are stored in the internal data memory 24. Selected ones of the sets of MIDI music data codes representative of famous music passages and some formation data codes may be stored in the read only memory 12. Sets of MIDI music data codes and sets of formation data codes are transferred from an external data source through the MIDI interface 14 to the internal data memory 24 or from the external memory 18 through the interface. Various sorts of large-capacity memories are available for the controller 3*a*. The external memory 18 may be accessible to a non-volatile portable rewritable memory such as, for example, a flash memory.

Data

The MIDI music data codes for the automatic player pianos are well known to persons skilled in the art. A set of MIDI music data codes representative of a piece of music is accompanied with header data codes, and the header data expresses the title, the tempo and so fourth. The set of MIDI music data codes expresses key events, i.e., note-on events/note-off events, note number assigned to the tone to be produced and velocity, duration for the lapse of time from the previous event and end of the piece of music.

Figure 3:
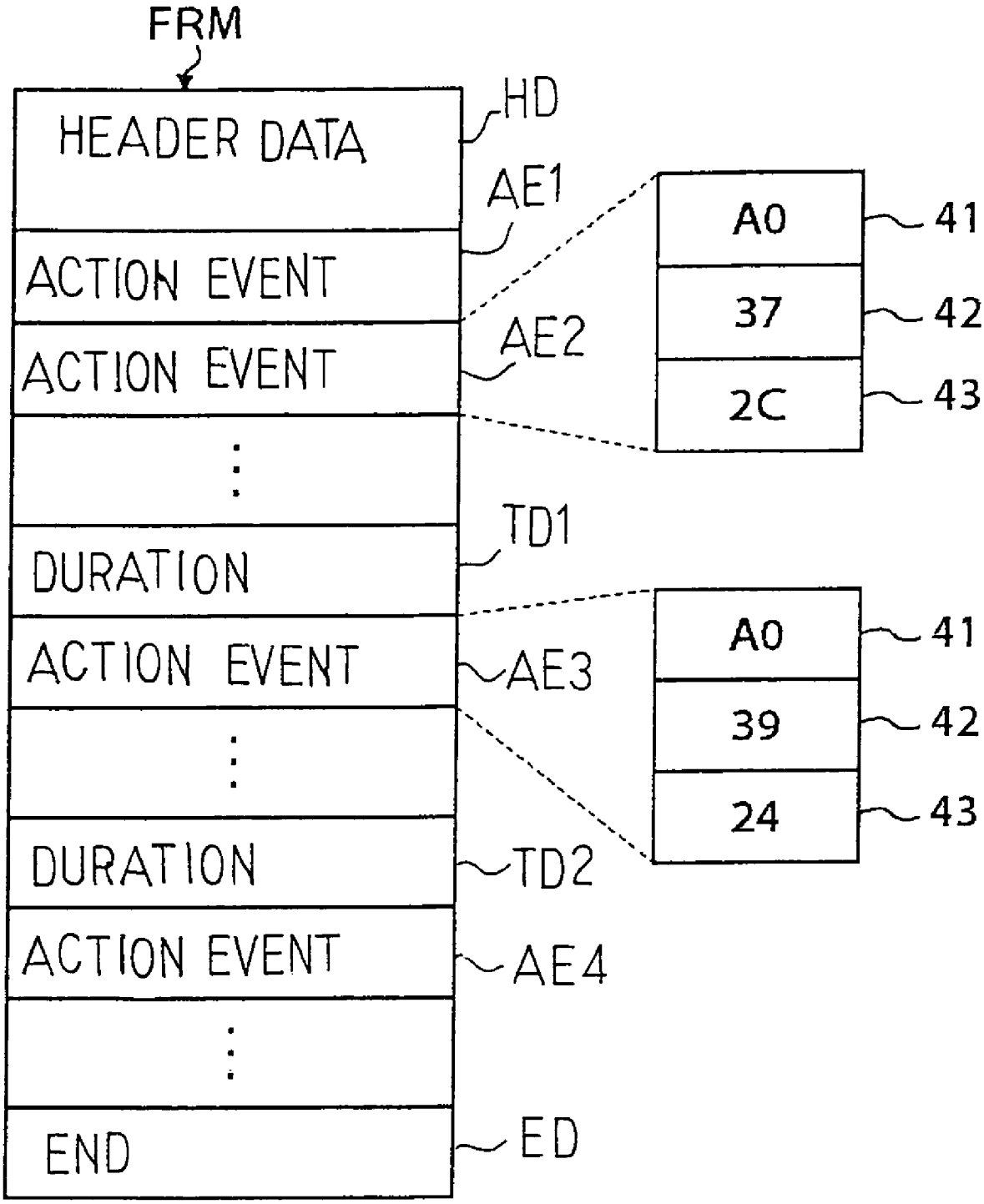
FIG. 3 is a view showing a set of formation data codes used in the keyboard musical instrument.

On the other hand, the formation data codes are unique to the keyboard musical instrument according to the present invention. The pieces of formation data are coded in the format defined in the MIDI protocols. FIG. 3 shows an example of a file FRM for a set of formation data codes. Although the formation data is coded in the formats same as those for the piece of music, the formation data does not make the keyboard musical instrument 30 perform any piece of music, but causes controlling system 3 to lay the black and white keys 31*a*/31*b* on an artistic pattern.

In detail, the set of formation data codes is also accompanied with header data codes HD, and includes action event codes AE1, AE2, AE3, AE4 representative of action events, duration data codes TD1, TD2 and an end data code ED. The duration data codes TD1, TD2 are corresponding to the duration data codes representative of the lapse of time from the previous key events, and also expresses the lapse of time from the previous action events. The end data code ED is also indicative of the end of the set of formation data codes.

The action event data codes AE1, AE2, AE3 and AE4 are corresponding to the key event data codes representative of the note events. However, the controller 3*a* does not cause the associated solenoid-operated key actuator 20 strongly to push the black and white keys 31*a*/31*b*. The key velocity is so low that the black and white keys 31*a*/31*b* can not drive the hammers 32 for the rotation. In other words, the hammers 32 do not reach the associated strings 34 so that the strings 34 are not struck with the hammers 32. Thus, any tone is not produced on the basis of the action event codes AE1, AE2, AE3 and AE4. The critical velocity V0, at which the hammers 32 hardly reach the associated strings 34, is of the order of 10 millimeters per second in the automatic keyboard musical instrument 30.

Each action event is expressed by three bytes 41, 42 and 43. The first byte 41 is the status byte, and is expressed by the most significant bit of "1". On the other hand, the data bytes are expressed by the most significant bit of "0". The status byte "An" is assigned to the action events. Although the status byte "An" usually expresses the polyphonic key pressure, the polyphonic key pressure is useless in the automatic keyboard musical instrument, and, for this reason, one of the idling status byte "An" is assigned to the action events AE1, AE2, AE3, AE4. The status bytes "8*n*" and "9*n*" are respectively assigned to the note-off events and note-on events so that the controller 3*a* can discriminate the action events AE1 to AE4 from the note-off events and note-on events. If the channel "0" is assigned to the keyboard musical instrument, the action events AE1, AE2, AE3, AE4 are expressed as "A0", and the note-on events are expressed as "90".

Two data bytes 42 and 43 follow the status byte "An". The first data byte next to the status byte "9*n*" expresses the pitches of tones to be produced, i.e., the note number assigned to the black/white key to be moved, and the second data byte next to the first data byte expresses the velocity. Although the first data byte 42 also expresses the note number assigned to the black/white key 31*a*/31*b* to be moved, the second data byte 43 does not express the velocity. Since the status byte "An" requests the controller 3*a* to move the black/white keys at the critical velocity or less than the critical velocity, it is not necessary to specify the velocity. The second data byte 43 expresses the keystroke measured from the rest position, i.e., the depth which the depressed key is to reach. For example, the first data byte 42 of "37" and second data byte 43 of "2C" indicate that the controller 3*a* is expected to supply the driving signal to the solenoid-operated key actuator 20 associated with the key assigned the note number "37" until the key "37" reaches the end position "2C". Similarly, the first data byte 42 of "39" and second data byte 43 of "24" indicate that the controller 3*a* is expected to supply the driving signal to the solenoid-operated key actuator 20 associated with the key assigned the note number "39" until the key "39" reaches the depth "24" on the way to the end position.

The central processing unit 11 processes the action event code as follows. When the central processing unit 11 fetches the action event code from the internal data memory 24, the status byte 41 teaches that the plunger 38 is to project at a certain velocity equal to or less than the critical velocity V0, and the first data byte 42 teaches the black/white key 31*a*/31*b* to be moved for the action event. The second data byte 43 notifies the central processing unit 11 of the maximum value of the target keystroke or maximum value of the target depth. The timing at which the black/white key 31*a*/31*b* is to start is determined on the basis of the associated duration code.

When the time comes, the central processing unit 11 determines a reference trajectory, i.e., a series of values of target keystroke varied with time, and determines the magnetic force to be exerted on the plunger 38. The central processing unit 11 informs the driving circuit 20*a* of the initial value of the magnetic force, and the driving circuit 20*a* adjusts the driving signal to the magnitude equivalent to the initial value of the magnetic force. The driving signal is supplied to the solenoid-operated key actuator 20 associated with the black/white key 31*a*/31*b*, and the solenoid creates the magnetic field around the plunger 38. The target magnetic force is exerted on the plunger 38 in the magnetic field, and the plunger 38 starts to slowly project.

The built-in plunger sensor (not shown) monitors the plunger 38, and supplies the plunger position signal indicative of the current plunger position or the current keystroke to the central processing unit 11. The central processing unit 11 compares the current keystroke with the target keystroke to see whether or not the black/white key 31*a*/31*b* exactly travels on the reference trajectory. If the central processing unit 11 finds a difference between the current keystroke and the target keystroke, the central processing unit 11 requests the driving circuit 20*a* to vary the magnitude of the driving signal. On the other hand, when the central processing unit 11 finds the black/white key 31*a*/31*b* exactly traveling on the reference trajectory, the driving circuit 20*a* keeps the driving signal at the present value of the magnitude.

When the black/white key 31*a*/31*b* reaches the maximum value of the target keystroke, the built-in plunger sensor notifies the central processing unit 11 of the arrival, and the central processing unit 11 requests the driving circuit 20*a* to reduce the magnitude of the driving signal to a value equivalent to the magnetic force balanced with the self-weight of the black/white key 31*a*/31*b*, action unit 33 and hammer 32. As a result, the solenoid-operated key actuator 20 keeps the black/white key 31*a*/31*b* at the maximum value of the target keystroke until the central processing unit 11 requests the driving circuit 20*a* to retract the plunger 38.

First Example of Artistic Visual Expression

Figure 4:
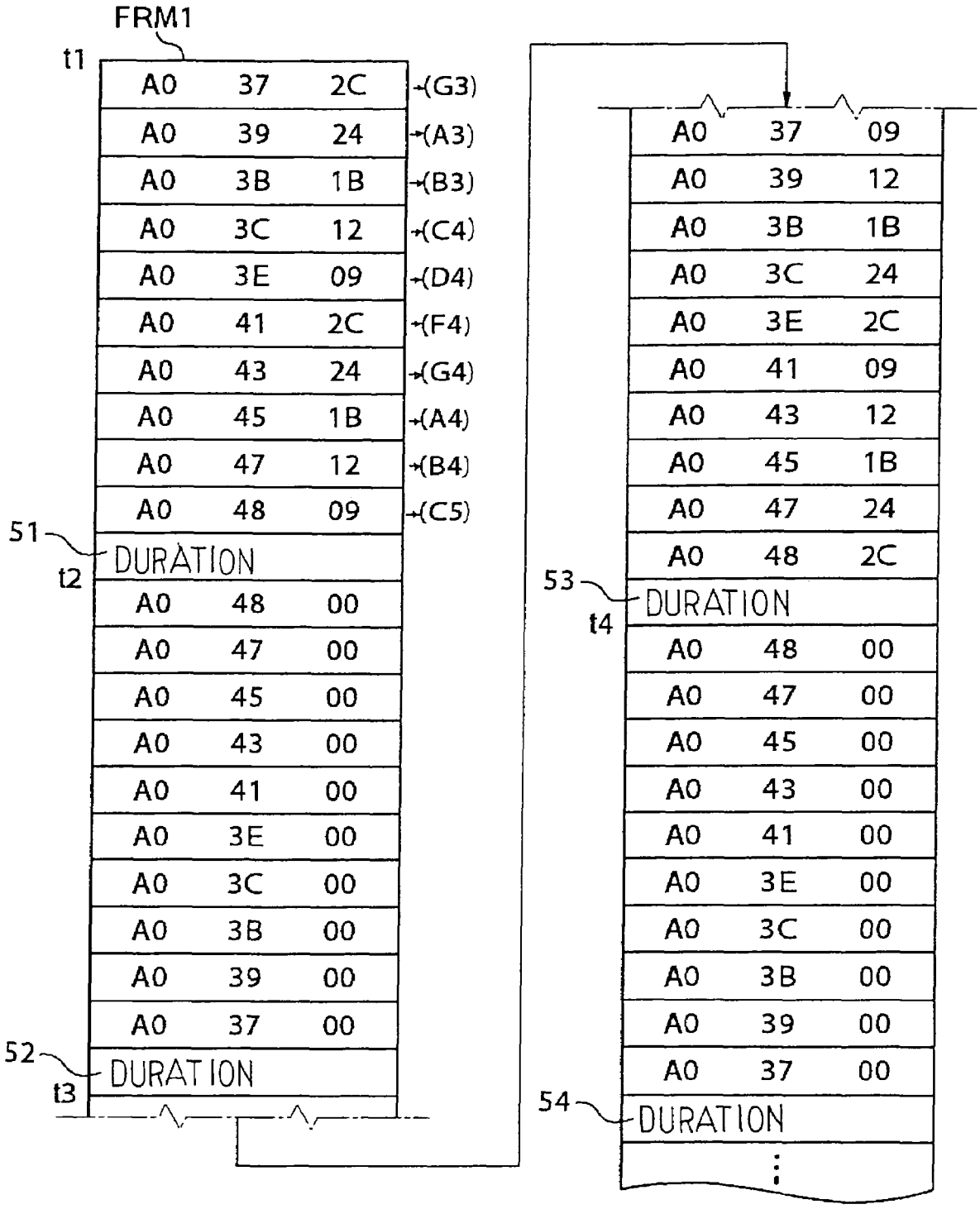
FIG. 4 is a view showing a set of formation data codes used in the keyboard musical instrument.

Description is hereinafter made on the artistic visual expression. FIG. 4 shows a set of formation data codes FRM1. In this instance, the white keys 31*b* assigned the pitch names G3, A3, B3, C4, D4, E3, F4, G4, A4, B4 and C5 perform the artistic visual expression. Ten action events repeatedly take place at time t1, time t2, time t3 and time t4, and the duration data codes 51, 52 and 53 express time periods (t2–t1), (t3–t2) and (t4–t3), respectively. The note numbers 37, 39, 3B, 3C, 3E, 41, 43, 45, 47 and 48 are respectively assigned the keys G3, A3, B3, C4, D4, E3, F4, G4, A4, B4 and C5.

The central processing unit 11 successively fetches the ten action event codes are "A0 37 2C" to "A0 48 09" from the internal data memory 24 at time t1, and processes these action event codes for producing the control signals representative of the motion of the keys A3, B3, C4, D4, E3, F4, G4, A4, B4 and C5. The second byte "2C" is indicative of the deepest key position, and the second byte "09" is indicative of the shallowest key position so that the central processing unit 11 produces the control signals indicative of the different values of the magnitude.

Figure 5:
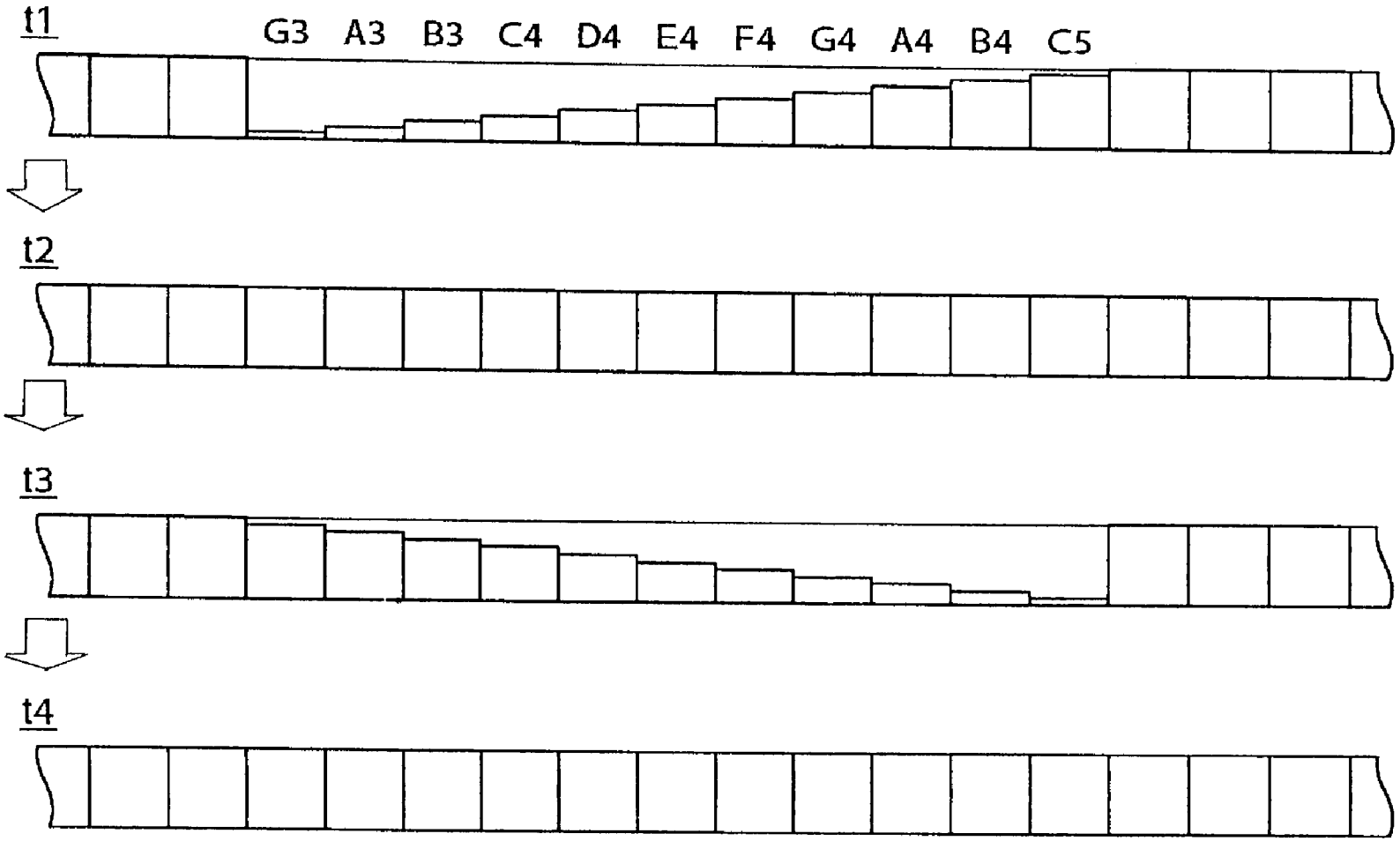
FIG. 5 is a front view showing white keys laid on artistic patterns on the basis of the set of formation data codes shown in FIG. 4.

The control signals are supplied from the central processing unit 11 to the driver circuit 20*a*, and the driver circuit 20*a* tailors the driving signals on the basis of the control signals. The driving signals are supplied to the solenoid-operated key actuators 20 associated with the white keys A3, B3, C4, D4, E3, F4, G4, A4, B4 and C5, respectively, so that the plungers 38 project over the different strokes. As a result, the white key "G3" is sunk to the deepest key position, and the white key "C5" is sunk to the shallowest key position. The other white keys "A3" to "B4" are differently sunk. As a result, the white keys "G3" to "C5" are laid on the pattern like steps as shown at "t1" in FIG. 5.

The central processing unit 11 fetches the duration data code 51 from the internal data memory 24, and determines the timing at which the next formation event codes "A0 48 00" to "A0 37 00" are to be processed. The central processing unit 11 periodically checks the timer 16 to see whether or not the timing comes.

The time period (t2–t1) is expired. Then, the central processing unit 11 sequentially fetches the next ten action event codes "A0 48 00" to "A0 37 00" from the internal data memory 24, and processes the action event data for producing the control signals. As shown in FIG. 4, the ten action event codes "A0 40 00" to "A0 37 00" are indicative of the depth of zero. The central processing unit 11 requests the driver circuits 20*a* to recover all the white keys "C5" to "G3" to the rest position. The driver circuits 20*a* removes the driving signals from the solenoid-operated key actuators 20 associated with the white keys "C5" to "G3". As a result, the white keys "C5" to "G3" are recovered to the rest position, and make the upper surfaces flat as shown at "t2" in FIG. 5.

The central processing unit 11 fetches the duration code 52 from the internal data memory 24, and determines the timing at which the next ten action event codes "A0 37 09" to "A0 48 2C" are to be processed. The central processing unit 11 periodically checks the timer 16 to see whether or not the timing comes.

When the timer 16 points to time "t3", the central processing unit 11 sequentially fetches the next ten action event codes "A0 37 09" to "A0 48 2C" from the internal data memory 24, and processes the action event data to produce the control signals. The second bytes 43 are different in value from one another, and the action event code "A0 37 09" and action event code "A0 48 2C" have the minimum keystroke and the maximum keystroke, respectively, and the action event codes therebetween have the respective second data bytes 43 stepwise varied from "12" to "24". The central processing unit 11 requests the driver circuit 20*a* to lay the white keys "G3" to "C5" on the visual pattern like steps. The driver circuit 20*a* changes the magnitude of the driving signals so that the white keys "G3" to "C5" are laid on the visual pattern like the steps as shown at "t3" in FIG. 5.

The central processing unit 11 fetches the duration data code 53 from the internal data memory 24, and determines the timing at which the next formation event codes "A0 48 00" to "A0 37 00" are to be processed. The central processing unit 11 periodically checks the timer 16 to see whether or not the timing comes.

When the time period (t4–t3) is expired, the central processing unit 11 sequentially fetches the next ten action event codes "A0 48 00" to "A0 37 00" from the internal data memory 24, and processes the action event data for producing the control signals. The ten action event codes "A0 48 00" to "A0 37 00" are indicative of the depth of zero. The central processing unit 11 requests the driver circuits 20*a* to recover all the white keys "C5" to "G3" to the rest position. The driver circuits 20*a* removes the driving signals from the solenoid-operated key actuators 20 associated with the white keys "C5" to "G3". As a result, the white keys "C5" to "G3" are recovered to the rest position, and make the upper surfaces flat as shown at "t4" in FIG. 5. As will be understood, the white keys "G3" and "C5" periodically change the depth, and perform as if the keyboard 31 is waved. This is the artistic visual expression. As described hereinbefore, the solenoid-operated key actuators 20 make the plungers 38 slowly push the keys 31*b*, and do not give rise to the rotation of hammers 32 to the strings 34. In other words, any piano tone is not produced during the performance.

Although the keyboard musical instrument is not equipped with any hammer stopper, which prevents the strings from the impacts with the hammers, the status byte "An" causes the driver circuit 20*a* to adjust the driving signals to the magnitude equivalent to the critical velocity. Although the new computer programs are installed in the controller 3*a*, the set of formation data codes is available for all the standard automatic keyboard musical instruments such as automatic player pianos without any retrofitting work.

Second Example of Artistic Visual Expression

The driver circuit 20*a* and solenoid-operated key actuators 20 perform the second example of the artistic visual expression in cooperation with the tone generator 21, effector 22 and sound system 23. In other words, the white keys G3, B3, D4, F4, A4 and C5 dance to a tune.

Figure 6:
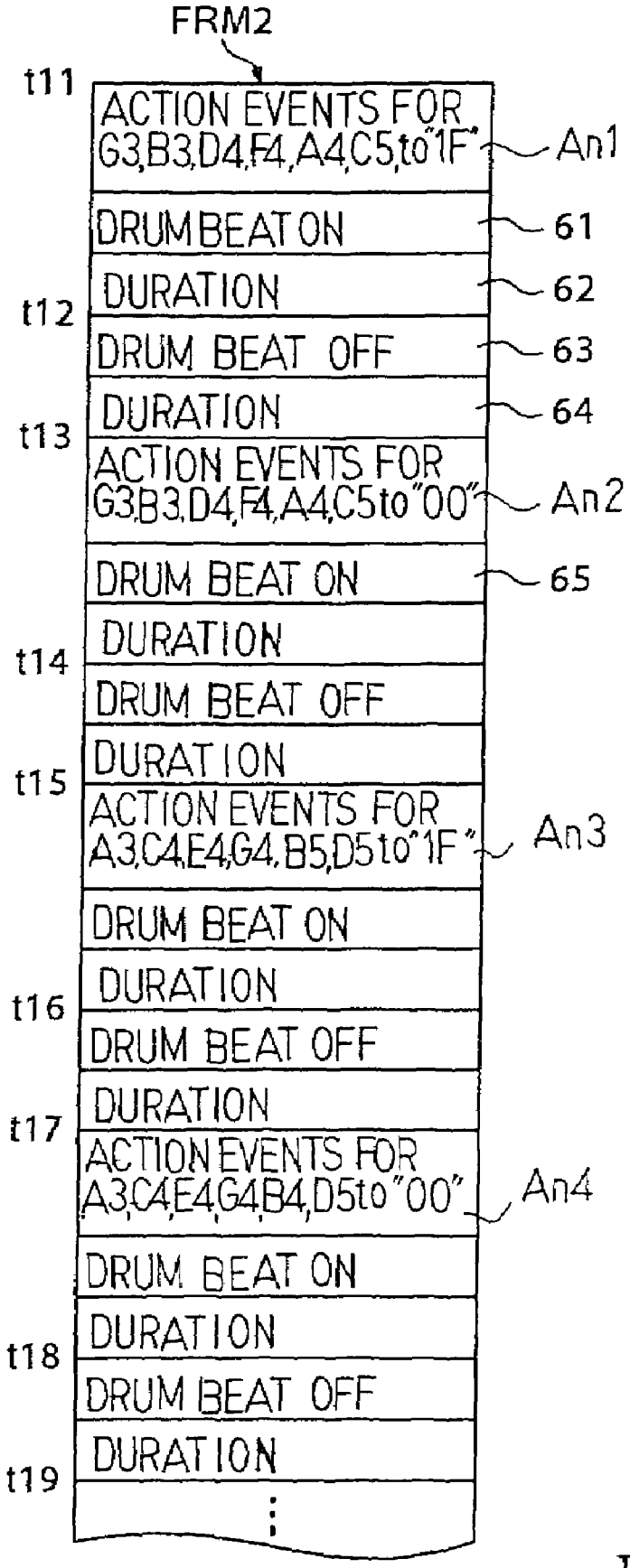
FIG. 6 is a view showing another set of formation data codes used in the keyboard musical instrument.
Figure 7:
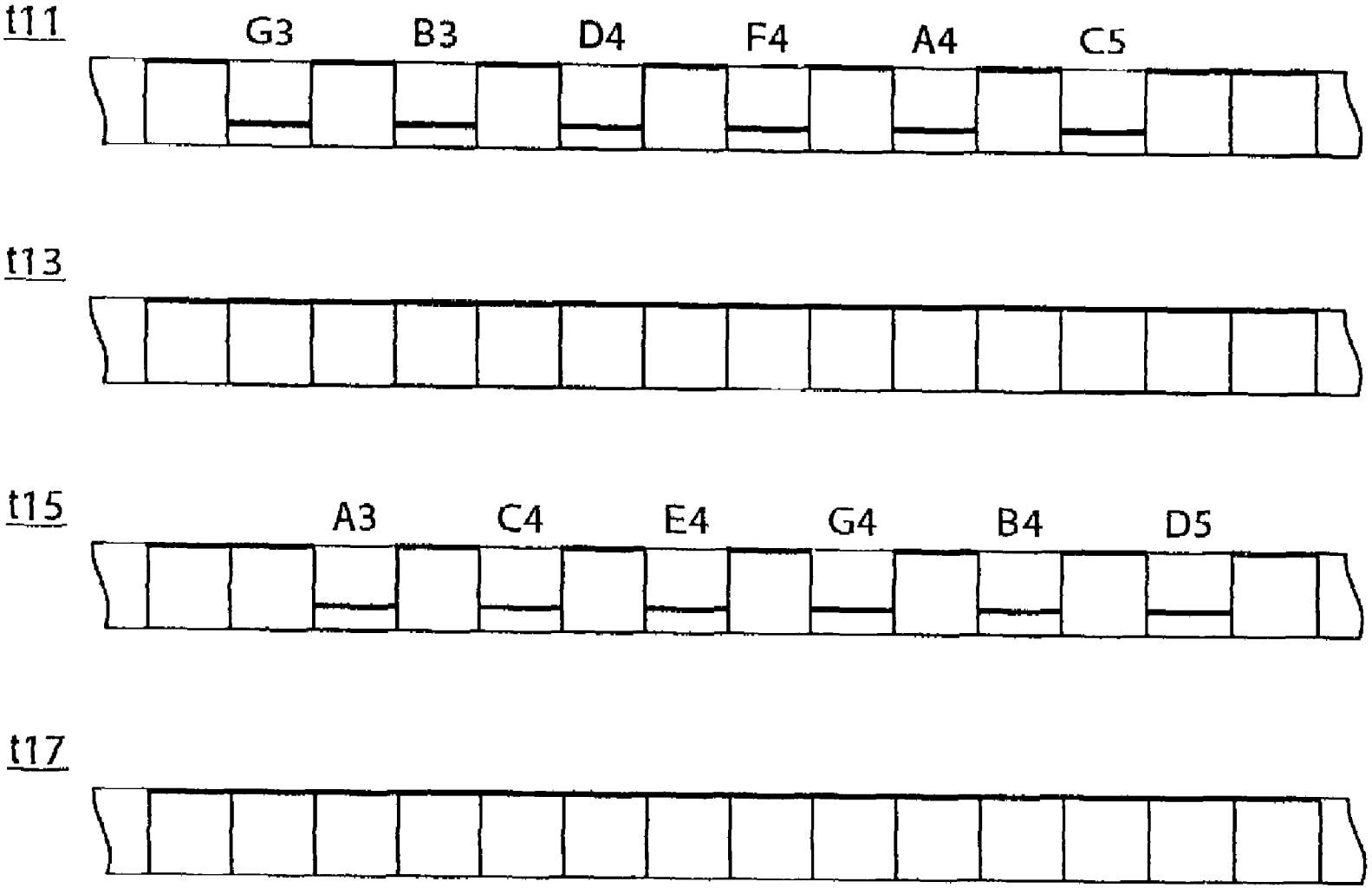
FIG. 7 is a front view showing white keys laid on artistic patterns on the basis of the set of formation data codes shown in FIG. 6.

FIG. 6 shows a set of formation data codes for the artificial visual expression to a performance on a drum or drums, and FIG. 7 shows the white keys G3, B3, D4, F4, A4 and C5 in the artistic visual expression. A user is assumed to instruct the central processing unit 11 to perform the artistic visual expression in drumbeats. The central processing unit 11 accesses the internal data memory 24, and sequentially fetches the formation data codes FRM2 for data processing.

When timer 16 points to time "t11", the central processing unit sequentially fetches the action event codes An1 from the internal data memory 24, and requests the driver circuit 20*a* to move the white keys G3, B3, D4, F4, A4 and C5 to the depth of "1F". The driver circuit 20*a* adjusts the driving signals to the magnitude equivalent to the depth of "1F", and supplies the solenoid-operated key actuators 20 so as to move the white keys G3 to C5 to the depth of "1F" as shown at time "t11" in FIG. 7.

Upon completion of the data processing for the white keys G3 to C5, the central processing unit 11 fetches the MIDI music data code 61 representative of the "drumbeat on" from the internal data memory 24, and supplies the MIDI music data code 61 to the tone generator 21. The tone generator 21 produces the digital audio signal representative of the drumbeat on the basis of the MIDI music data code 61, and supplies the audio signal through the effector 22 to the sound system 23. The sound system converts the audio signal to the drumbeat or drumbeats. Thus, the white keys G3 to C5 are moved synchronously with the drumbeat or drumbeats.

Subsequently, the central processing unit 11 fetches the duration code 62 from the internal data memory 24, and determines the timing at which the next formation data code is to be processed. When the timer 16 points to time "t12", the central processing unit 11 fetches the MIDI music data code 63 representative of "drumbeat off" from the internal data memory 24, and supplies the MIDI music data code 63 to the tone generator 21. The tone generator 21 decays the audio signal, and the drumbeat or drumbeats are extinguished.

Subsequently, the central processing unit fetches the duration code 64 from the internal data memory 24, and determines the timing at which the next formation data code is to be processed. When the timer 16 points to time "t13", the central processing unit sequentially fetches the action event codes An3 from the internal data memory 24, and requests the driver circuit 20*a* to move the white keys G3, B3, D4, F4, A4 and C5 to the rest position, i.e., depth of "00". The driver circuit 20*a* adjusts the driving signals to the magnitude equivalent to the depth of "00", and supplies the solenoid-operated key actuators 20 so as to move the white keys G3 to C5 to the rest position as shown at time "t13" in FIG. 7.

Upon completion of the data processing for the white keys G3 to C5, the central processing unit 11 fetches the MIDI music data code 65 representative of the "drumbeat on" from the internal data memory 24, and supplies the MIDI music data code 61 to the tone generator 21. The tone generator 21 produces the digital audio signal representative of the drumbeat or drumbeats on the basis of the MIDI music data code 65, and supplies the audio signal through the effector 22 to the sound system 23. The sound system converts the audio signal to the drumbeat or drumbeats. Thus, the white keys G3 to C5 are moved synchronously with the drumbeat or drumbeats, again.

Subsequently, the central processing unit 11 fetches the next duration code from the internal data memory 24, and determines the timing at which the next formation data code is to be processed. When the timer 16 points to time "t14", the central processing unit 11 fetches the next MIDI music data code representative of "drumbeat off" from the internal data memory 24, and supplies the MIDI music data code 63 to the tone generator 21. The tone generator 21 decays the audio signal, and the drumbeat or drumbeats are extinguished. Thus, the white keys G3 to C5 are moved synchronously with the drumbeat or drumbeats.

The central processing unit 11 processes the action event codes An3 for the white keys A3, C4, E4, G4, B4 and D5 and the MIDI music data code representative of the "drumbeat on" at time "t15", and the white keys A3 to D5 are sunk to the depth of "1F" in synchronism with the drumbeat or drumbeats as shown at "t15" in FIG. 7, and the drum beat or drumbeats are decayed at time t16.

The central processing unit 11 processes the action event codes An4 for the white keys A3 to D5 and the MIDI music data code representative of the "drumbeat on" at time t17, and the white keys A3 to D5 return to the rest position, i.e., the depth of "00" as shown at "t17" in FIG. 7. The drumbeat or drumbeats are decayed at time t18.

As will be understood, the white keys G3 to C5 and white keys A3 to D5 are alternately sunk to the depth of "1F" in synchronism with the drumbeat or drumbeats. Thus, the artistic visual expression is performed in the drumbeats.

Third Example of Artistic Visual Expression

Figure 8:
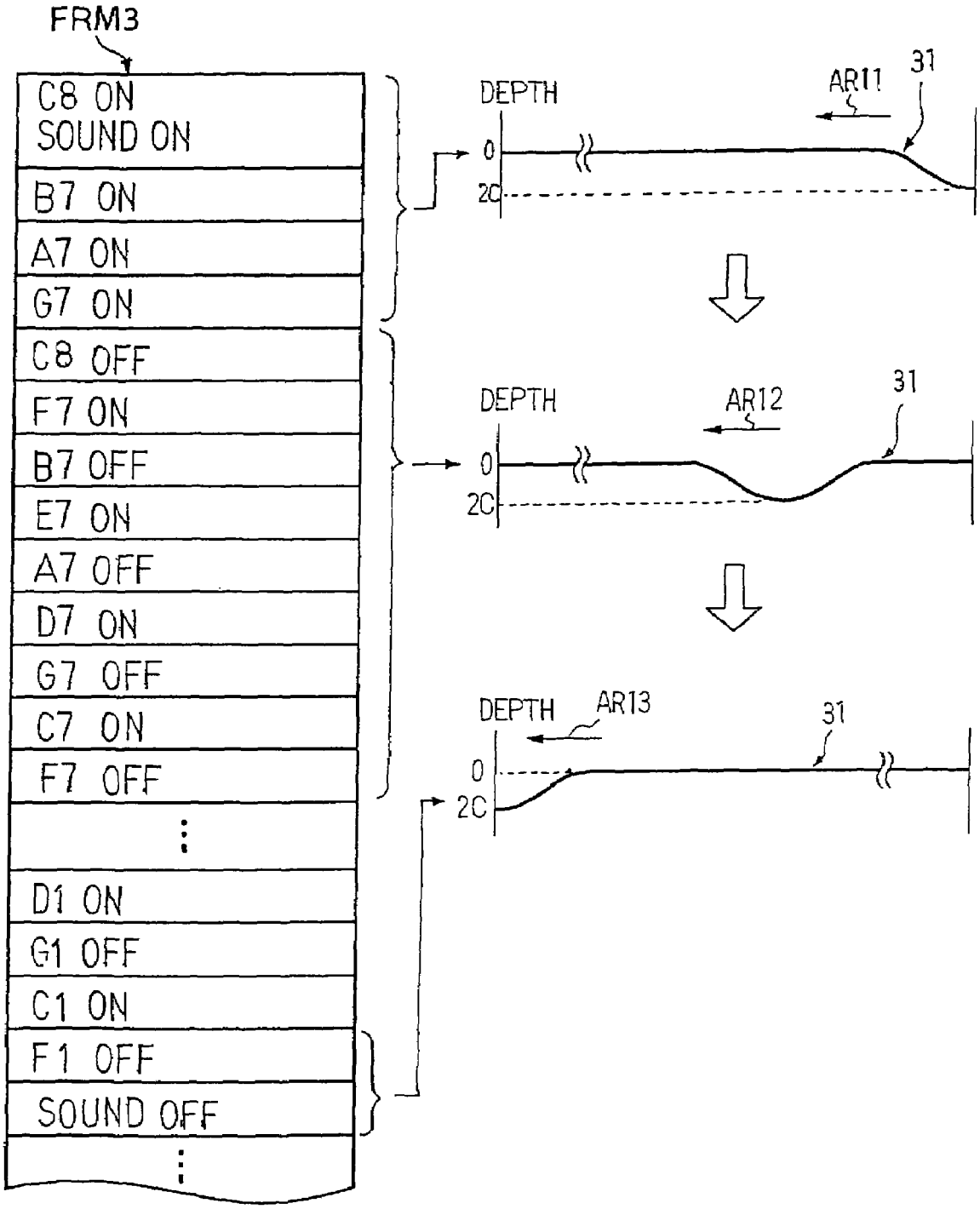
FIG. 8 is a view showing relation between yet another set of formation data codes and motion of the white keys.

In the third example, the white keys 3*b* are sequentially sunk to the depth of "2C", and sequentially return to the rest position, i.e., the depth of "00" in the sound of waves. FIG. 8 shows yet another set of formation data codes FRM3 and an artistic visual expression like waves. In FIG. 8, "C8 ON" to "C1 ON2 mean that the white keys assigned the pitch names "C8" to "C1" are sunk to the depth of "2C", and "C8 OFF" to "F1 OFF" mean that the white keys "C8" to "F1" return to the rest position or the depth of "00". The term "SOUND ON" means that the sound system 23 starts to produce the sound of waves, and the term "SOUND OFF" means that the sound system 23 stops the sound of waves. Although the duration data code is inserted between adjacent action event codes, the duration data codes are deleted from FIG. 8.

The white key C8 is firstly sunk to the depth of "2C", and the sound of waves is radiated from the sound system 23. The white keys B7, A7, G7 are sequentially sunk to the depth of "2C" so that the wave starts the right side of the keyboard 31 as indicated by arrow AR11 concurrently with the sound of waves.

Subsequently, the white keys 31*b* are alternately sunk to the depth of "2C", and return to the rest position at "00". The plunger motion is slow enough to express the wave propagated toward the left side of the keyboard 31 as indicated by arrow AR12. The sound of waves is continuously produced from the sound system 23.

When the wave reaches the right side of the keyboard 31, the white keys 31*b* successively return to the rest position as indicated by arrow AR13. Finally, the rightmost white key 1F returns to the rest position, and the sound system 23 stops producing the sound of waves.

The sound of waves may not stop at the return of the rightmost white key to the rest position, but be continued during repetition of the key motion from the rightmost white key C8 to the leftmost white key F1.

As will be understood, the set of formation data codes FRM3 makes the solenoid-operated key actuators 20 give rise to the wave or waves through the keyboard 31 in the sound of waves. Thus, the artistic visual expression is dynamically performed on the keyboard 31.

Fourth Example of Artistic Visual Expression

Figures 9A, 9B, 9C:
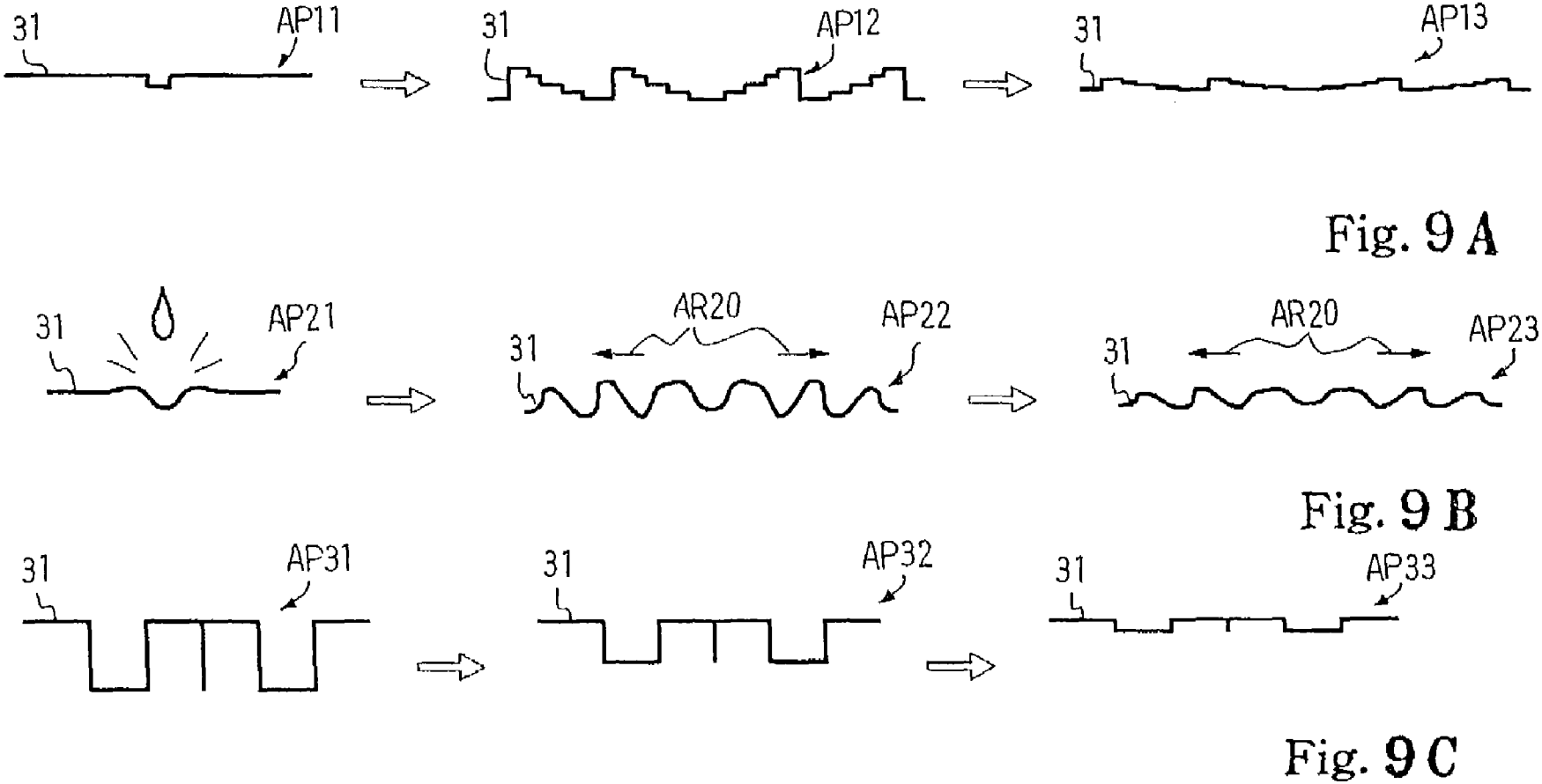
FIGS. 9A to 9C are views showing artistic visual expressions produced in the keyboard musical instrument.

FIG. 9A shows still another artistic visual expression created by the controlling system 3. A set of formation data codes contains not only the action event data codes but also MIDI music data codes representative of a sound effect. The sound effect is timely produced in synchronism with the artistic visual expression.

When the solenoid-operated key actuator 20 sinks the white key 31*b* at the mid of the keyboard 31 as indicated by the artistic pattern AP11, the sound system 23 produces the pattering of raindrops. Thereafter, the controller 3*a* stops the sound effect. The solenoid-operated key actuators 20 start to sequentially depress the white keys 31*b* from the mid of the keyboard 31 toward both sides like ripples as indicated by the artistic pattern AP12. The depth is gradually reduced as indicated by the artistic pattern AP13. Finally, the ripples are removed from the keyboard 31. Thus, the series of artistic patterns AP11 to AP13 and sound effect make the audience reminded of the ripples on the surface of a pond.

Fifth Example of Artistic Visual Expression

Yet another set of formation data codes contains video data codes representative of visual images to be produced on the display window 17. The visual images are mixed with the action event codes, and the duration data codes are selectively inserted into the series of action event codes and video data codes. In this instance, when the white key 31*b* at the mid of the keyboard 31 is sunk, the image of a raindrop is reproduced on the display window 17 as indicated by AP21 in FIG. 9B. While the white keys 31*b* are sequentially sinking to the given depth, the images of ripples are produced on the display window 17 as indicated by AP22 and AP23. The images of ripples proceed toward both sides as indicated by arrow AR20, and are well synchronized with the key motion shown in FIG. 9A.

Sixth Example of Artistic Visual Expression

FIG. 9C shows a key motion moved in synchronism with the decay of tones. Firstly, a tone is produced at the maximum loudness, and the white keys 31*b* are sunk to the maximum depth as indicated by the artistic pattern AP31 in FIG. 9C. While the ton is being gradually decayed, the depressed keys float up toward the rest position as indicated by the artistic patterns AP32 and AP33. When the keys reach the rest position, the tone is extinguished.

As will be understood from the foregoing description, the keyboard musical instrument according to the present invention is equipped with the controller 3*a*, which exactly interprets the action event data coded in the idling format of the MIDI protocols. The controller 3*a* makes the solenoid-operated key actuators 20 give rise to the key motion without producing any piano tone. As a result, the audience enjoys the artistic visual expression on the keyboard 31. Thus, the keyboard musical instrument according to the present invention offers the third option to the users and audience.

Although particular embodiments of the present invention have been shown and described, it will be apparent to those skilled in the art that various changes and modifications may be made without departing from the spirit and scope of the present invention.

The acoustic piano 1 does not set any limit on the technical scope of the present invention. The controlling system 3 may be installed in an organ, a harpsichord or an electric keyboard. Moreover, the present invention is applicable to any sort of musical instrument equipped with an automatic playing system. Otherwise, the controlling system may be retrofitted to musical instruments with plural manipulators. For example, a controlling system may be prepared for wind instruments with plural keys. Otherwise, a controlling system may be installed in a percussion instrument such as, for example, a celesta.

Another status byte, which stands idle in the automatic keyboard musical instrument 30, may be assigned to the action events. Thus, the status byte "An" does not set any limit to the technical scope of the present invention.

While the image of raindrop is dropping to the water surface of the pond, the sound system 23 may produce the sound effect. In this instance, the video data codes and MIDI music data codes representative of the sound effect are mixed into the action event data codes and duration codes.

The image of raindrop and sound effect do not set any limit on the technical scope of the present invention. Any sort of sound or any music passage is available for the keyboard musical instrument. For example, the black/white keys 31*a*/31*b* may be moved as if the black/white keys 31*a*/31*b* sway in the wind. In this instance, the sound effect makes the audience reminded of the wind. Otherwise, the black/white keys 31*a*/31*b* may be moved as if dancers are stepping on the keyboard 31. In this instance, a piece of music is produced through the sound system.

The keyboard 31 may be split into two parts, one of which is used in a performance through the piano tones, and the other of which is used for the artistic visual expression.

Moreover, the MIDI music data codes representative of the note-on/note-off may be mixed with the action event data codes. When the central processing unit 11 fetches the MIDI music data codes representative of the note events from the internal data memory 24, the central processing unit 11 requests the driver circuit 20*a* to give rise to the key motion at the given velocity for producing the piano tones. If, on the other hand, the central processing unit 11 fetches the action event codes from the internal data memory 24, the central processing unit 11 requests the driver circuit 20*a* to give rise to the key motion at or lower than the critical velocity so that the keys 31*a*/31*b* are moved without producing any piano tone. In this instance, it is recommendable to space the keys 31*a*/31*b* moved at or lower than the critical velocity from the keys 31*a*/31*b* moved for producing the piano tones.

The black/white keys 31*a*/31*b* do not set any limit to the technical scope of the present invention. In case where foot pedals are accompanied with pedal actuators, the controller may give rise to the pedal motion for the artistic visual expression.

The MIDI protocols do not set any limit to the technical scope of the present invention. Any protocols applicable to musical instruments are available for the artistic visual expression. For example, the action event code may be expressed by a 24-bit data code or another multi-bit data code in another protocol.

The sets of formation data codes may be prepared by a music designer. However, the users may design a new artistic visual expression through fingering on the keyboard 31.

The built-in plunger sensors do not set any limit to the technical scope of the present invention. The relation between the magnitude of the driving signals and the plunger stroke is so clear that the controller 3*a* can move the plungers 38 over specific values of the stroke without any feedback signal.

Claim languages are correlated with the component parts of the keyboard musical instruments implementing the embodiment as follows. The black/white keys 31*a*/31*b* serve as "manipulators", and the pitch of the tones is corresponding to an "attribute" of the tones. The action units 33, hammers 32, strings 34 and dampers 36 as a whole constitute a "tone generating system".

The status byte, first data byte and second data byte serve as a "first bit string", a "second bit string" and a "third bit string", respectively. The polyphonic key pressure is corresponding to "another message". The tone generator 21, effector 22 and sound system 23 as a whole an "electric tone generating system". The duration codes serve as "time data codes". The display window 17 serves as a "display unit".

What is claimed is:

1. A musical instrument for producing tones, comprising:

plural manipulators assigned respective manipulator numbers, and selectively moved between respective rest positions and respective end positions for specifying an attribute of said tones;

a tone generating system connected to said plural manipulators, and actuated by said plural manipulators for producing said tones at said attribute specified through said plural manipulators; and a controlling system including plural actuators respectively associated with said plural manipulators, and responsive to driving signals so as to give rise to motion of said plural manipulators, and a controller analyzing action event codes indicative of at least a velocity of the manipulators to be moved without producing said tones, the manipulator numbers of said manipulators and a stroke from the rest positions and supplying said driving signals representative of said velocity and target values of said stroke to the actuators associated with said manipulators to be moved, the driving signals produced on the basis of said action event codes making said manipulators start to return toward said rest positions before the actuation of said tone generating system without any interruption of another component parts of said musical instrument.

2. The musical instrument as set forth in claim 1, in which each of said action event codes has a first bit string representative of an action event realized through said motion of said manipulators to be moved without producing said tones, a second bit string representative of one of said numbers, and a third bit string representative of a value of said stroke.

3. The musical instrument as set forth in claim 2, in which said first bit string represents another message not used in said musical instrument and defined in predetermined protocols.

4. The musical instrument as set forth in claim 3, in which MIDI protocols serve as said predetermined protocols.

5. The musical instrument as set forth in claim 1, in which said controller further analyzes music data codes representative of note events for producing other driving signals, and said plural actuators are further responsive to said other driving signals so as selectively to move said plural manipulators for producing said tones.

6. The musical instrument as set forth in claim 5, in which said music data codes are defined in predetermined protocols, and said action event codes are defined in said predetermined protocols as another sort of events which does not occur in said musical instrument.

7. The musical instrument as set forth in claim 6, in which MIDI protocols serve as said predetermined protocols.

8. The musical instrument as set forth in claim 1, further comprising an electric tone generating system connected to said controlling system, wherein said controller further analyzes sound data codes representative of sound so as to supply said sound data codes to said electric tone generating system for producing said sound together with an artistic visual expression performed by said manipulators.

9. The musical instrument as set forth in claim 8, in which said sound is produced in synchronism with said artistic visual expression on the basis of time data codes mixed into a series of said action event codes and said sound data codes.

10. The musical instrument as set forth in claim 1, further comprising a display unit connected to said controlling system, wherein said controller further analyzes video data codes representative of visual images so as to supply said video data codes to said display unit for producing said visual images on said display unit together with an artistic visual expression performed by said manipulators.

11. The musical instrument as set forth in claim 10, in which said visual images are produced in synchronism with said artistic visual expression on the basis of time data codes mixed with a series of said action event codes and said video data codes.

12. The musical instrument as set forth in claim 1, in which black and white keys serve as said plural manipulators, and said tone generating system includes action units respectively linked with said black and white keys, dampers linked with said black and white keys, hammers driven for rotation by said action units and strings struck by said hammers.

13. The musical instrument as set forth in claim 12, in which said action event codes cause said actuators to move said black and white keys at a low key velocity which prohibits said strings from the strike by said hammers.

14. A controlling system to be installed in a musical instrument and selectively moving plural manipulators forming parts of said musical instrument, comprising:

plural actuators respectively associated with said plural manipulators, and responsive to driving signals so as selectively to give rise to motion of said plural manipulators; and a controller analyzing action event codes indicative of at least a velocity of the manipulators to be moved without producing a tone, manipulator numbers of said manipulators and a stroke of said manipulators, and supplying said driving signals representative of said velocity and target values of said stroke to the actuators associated with said manipulators to be moved, the driving signals produced on the basis of said action event codes making said manipulators start to return toward said rest positions before the actuation of said tone generating system without any interruption of another component parts of said musical instrument.

15. The controlling system as set forth in claim 14, in which each of said action event codes has a first bit string representative of an action event realized through said motion of said manipulators to be moved without producing said tones, a second bit string representative of one of said numbers, and a third bit string representative of a value of said stroke.

16. The controlling system as set forth in claim 15, in which said first bit string represents another message not used in said musical instrument and defined in predetermined protocols.

17. The controlling system as set forth in claim 16, in which MIDI protocols serve as said predetermined protocols.

18. The controlling system as set forth in claim 14, in which said controller further analyzes music data codes representative of note events for producing other driving signals, and said plural actuators are further responsive to said other driving signals so as selectively to move said plural manipulators for producing said tones.

19. The controlling system as set forth in claim 18, in which said music data codes are defined in predetermined protocols, and said action event codes are defined in said predetermined protocols as another sort of events which does not occur in said musical instrument.

20. The controlling system as set forth in claim 19, in which MIDI protocols serve as said predetermined protocols.

21. The controlling system as set forth in claim 14, in which said controller further analyzes sound data codes representative of sound so as to supply said sound data codes to an electric tone generating system for producing said sound together with an artistic visual expression performed by said manipulators.

22. The controlling system as set forth in claim 21, in which said sound is produced in synchronism with said artistic visual expression on the basis of time data codes mixed into a series of said action event codes and said sound data codes.

23. The controlling system as set forth in claim 14, in which said controller further analyzes video data codes representative of visual images so as to supply said video data codes to a display unit for producing said visual images on said display unit concurrently with an artistic visual expression performed by said manipulators.

24. The controlling system as set forth in claim 23, in which said visual images are produced in synchronism with said artistic visual expression on the basis of time data codes mixed with a series of said action event codes and said video data codes.

* * * * *